US009132980B2

(12) United States Patent
Harada

(10) Patent No.: US 9,132,980 B2
(45) Date of Patent: Sep. 15, 2015

(54) PRINTING APPARATUS, METHOD FOR CONTROLLING THE SAME, AND STORAGE MEDIUM

(71) Applicant: CANON KABUSHIKI KAISHA, Tokyo (JP)

(72) Inventor: Takuto Harada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/975,080

(22) Filed: Aug. 23, 2013

(65) Prior Publication Data

US 2014/0062015 A1 Mar. 6, 2014

(30) Foreign Application Priority Data

Sep. 4, 2012 (JP) ..... 2012-194406

(51) Int. Cl.

| | |
|---|---|
| ***B65H 29/00*** | (2006.01) |
| ***B65H 29/62*** | (2006.01) |
| ***B65H 31/24*** | (2006.01) |
| ***B65H 43/04*** | (2006.01) |
| ***G03G 15/00*** | (2006.01) |

(52) U.S. Cl.

CPC ..... *B65H 29/00* (2013.01); *B65H 29/62* (2013.01); *B65H 31/24* (2013.01); *B65H 43/04* (2013.01); *G03G 15/6585* (2013.01); *B65H 2301/52* (2013.01); *B65H 2557/63* (2013.01); *B65H 2801/06* (2013.01); *G03G 2215/00902* (2013.01)

(58) Field of Classification Search

CPC ..... B65H 29/62; G06K 15/16

USPC ..... 271/179, 288, 289, 298

See application file for complete search history.

(56) References Cited

U.S. PATENT DOCUMENTS

| | | | | |
|---|---|---|---|---|
| 5,649,627 | A * | 7/1997 | Wako | 209/534 |
| 6,283,472 | B1 * | 9/2001 | Brod | 271/279 |
| 6,804,473 | B2 * | 10/2004 | Nakamura et al. | 399/16 |
| 6,900,902 | B1 * | 5/2005 | Tanaka | 358/1.13 |
| 7,017,903 | B2 * | 3/2006 | Fujii et al. | 271/298 |
| 8,040,535 | B2 * | 10/2011 | Kurahashi et al. | 358/1.12 |

(Continued)

FOREIGN PATENT DOCUMENTS

| | | |
|---|---|---|
| CN | 1467577 A | 1/2004 |
| CN | 102004405 A | 4/2011 |

(Continued)

OTHER PUBLICATIONS

Chinese Office Action dated May 6, 2015 issued in corresponding Chinese Patent Application No. 201310392823.9.

*Primary Examiner* — Jeremy R Severson

(74) *Attorney, Agent, or Firm* — Fitzpatrick, Cella, Harper & Scinto

(57) ABSTRACT

There is provided a technique of allowing the user to readily identify a printed material with a stable tint when a plurality of printed materials are output in a printing apparatus. To achieve this, a printing apparatus according to one aspect of the invention executes an adjustment job for printing an image on a plurality of sheets for adjusting the tint of the printed image, and controls to discharge, to a first discharge unit, a predetermined number of sheets among the plurality of sheets on which the image is printed by executing the adjustment job, and to discharge, to a second discharge unit different from the first discharge unit, a remaining sheet subsequent to the predetermined number of sheets.

8 Claims, 8 Drawing Sheets

(56) References Cited

U.S. PATENT DOCUMENTS

| | | | | |
|---|---|---|---|---|
| 8,167,308 | B2 * | 5/2012 | Tanaka | 271/298 |
| 8,305,628 | B2 | 11/2012 | Harada | |
| 8,520,256 | B2 | 8/2013 | Yamazaki | |
| 2006/0033770 | A1 | 2/2006 | Yamasaki et al. | |
| 2007/0175912 | A1 * | 8/2007 | Uehara et al. | 221/30 |
| 2008/0010075 | A1 | 1/2008 | Moody | |
| 2008/0174793 | A1 | 7/2008 | Mutsuno | |
| 2012/0194858 | A1 | 8/2012 | Matsushita | |
| 2012/0257225 | A1 * | 10/2012 | Fukaya | 358/1.9 |
| 2013/0270064 | A1 * | 10/2013 | Eberhard | 198/358 |
| 2013/0341861 | A1 * | 12/2013 | Kanamoto | 271/288 |

FOREIGN PATENT DOCUMENTS

| | | | |
|---|---|---|---|
| JP | 2004-200955 | A | 7/2004 |
| JP | 2008-176581 | A | 7/2008 |

* cited by examiner

FIG. 4

302

| H/W ARRANGEMENT | CONNECTION STATE | DISCHARGE UNIT |
|---|---|---|
| PRINTING APPARATUS MAIN BODY 101 | CONNECTION | INSIDE APPARATUS (108) |
| DISCHARGE ACCESSORY 103 | CONNECTION | NONE |
| DISCHARGE ACCESSORY 104 | CONNECTION | NONE |
| DISCHARGE ACCESSORY 105 | CONNECTION | OUTSIDE APPARATUS (109) |
| FEEDING ACCESSORY 102 | CONNECTION | NONE |
| DISCHARGE ACCESSORY A | NON-CONNECTION | OUTSIDE APPARATUS |

PRINTING APPARATUS, METHOD FOR CONTROLLING THE SAME, AND STORAGE MEDIUM

BACKGROUND OF THE INVENTION

1. Field of the Invention

The present invention relates to a printing apparatus, a method for controlling the same, and a storage medium.

2. Description of the Related Art

A printing apparatus used in a POD (Print On Demand) environment as described in Japanese Patent Laid-Open No. 2008-176581 often adjusts the tint of an image by outputting an arbitrary number of printed materials in order to stabilize the tint of the image formed on the printed material output by print processing. In this case, the last output one of the plurality of printed materials output for adjustment of the tint of the image may be used in the next step such as post-processing. That is, since the tint of the last output printed material should have been adjusted and have already stabilized, it is possible to effectively use the resources by utilizing the printed material in the next step.

In a printing apparatus, when outputting a plurality of printed materials to adjust the tint of the printed material as described above, all the printed materials are generally output and stacked on a specific discharge destination such as a discharge tray. Upon completion of output of the plurality of printed materials, the user recognizes, for example, the top one of the plurality of printed materials stacked on the discharge destination as the last output printed material, and uses it for post-processing or the like.

In the above-described printing apparatus, however, if a plurality of printed materials are continuously output, the user may erroneously recognize, as a printed material with a stable tint, a printed material which actually has an unstable tint. For example, assume that printing is halted due to some reason, and not all the plurality of printed materials which should be output to adjust the tint of the printed material have been output onto the discharge tray yet. In this case, even though the top one of the plurality of printed material already stacked on the discharge tray is not a printed material with a stable tint, the user may erroneously use the printed material for post-processing. That is, the user may erroneously use, for post-processing, a printed material with an unstable tint.

To avoid such situation, the user needs to check whether the top one of the printed materials stacked on the discharge tray is a printed material with a stable tint, by counting the number of printed materials output onto the discharge tray.

SUMMARY OF THE INVENTION

The present invention has been made in consideration of the above problem. The present invention provides a technique of allowing the user to readily identify a printed material with a stable tint when a plurality of printed materials are output in a printing apparatus.

According to one aspect of the present invention, there is provided a printing apparatus comprising: an execution unit configured to execute an adjustment job for printing an image on a plurality of sheets for adjusting a tint of the printed image; and a control unit configured to control to discharge, to a first discharge unit, a predetermined number of sheets among the plurality of sheets on which the image is printed by executing the adjustment job by the execution unit, and to discharge, to a second discharge unit different from the first discharge unit, a remaining sheet subsequent to the predetermined number of sheets.

According to another aspect of the present invention, there is provided a method for controlling a printing apparatus, comprising steps of: executing an adjustment job for printing an image on a plurality of sheets for adjusting a tint of the printed image; and controlling to discharge, to a first discharge unit, a predetermined number of sheets among the plurality of sheets on which the image is printed by executing the adjustment job in the execution step, and to discharge, to a second discharge unit different from the first discharge unit, a remaining sheet subsequent to the predetermined number of sheets.

According to still another aspect of the present invention, there is provided a computer-readable storage medium storing a computer program for causing a computer to execute steps of a method for controlling a printing apparatus, the method comprising steps of: executing an adjustment job for printing an image on a plurality of sheets for adjusting a tint of the printed image; and controlling to discharge, to a first discharge unit, a predetermined number of sheets among the plurality of sheets on which the image is printed by executing the adjustment job in the execution step, and to discharge, to a second discharge unit different from the first discharge unit, a remaining sheet subsequent to the predetermined number of sheets.

According to the present invention, it is possible to provide a technique of allowing the user to readily identify a printed material with a stable tint when a plurality of printed materials are output in a printing apparatus.

Further features of the present invention will become apparent from the following description of exemplary embodiments (with reference to the attached drawings).

BRIEF DESCRIPTION OF THE DRAWINGS

FIG. 4 is a view showing an example of data stored in a database 302 in the printing apparatus 100 according to the embodiment of the present invention;

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

<Arrangement of Printing Apparatus 100>

Figure 1:
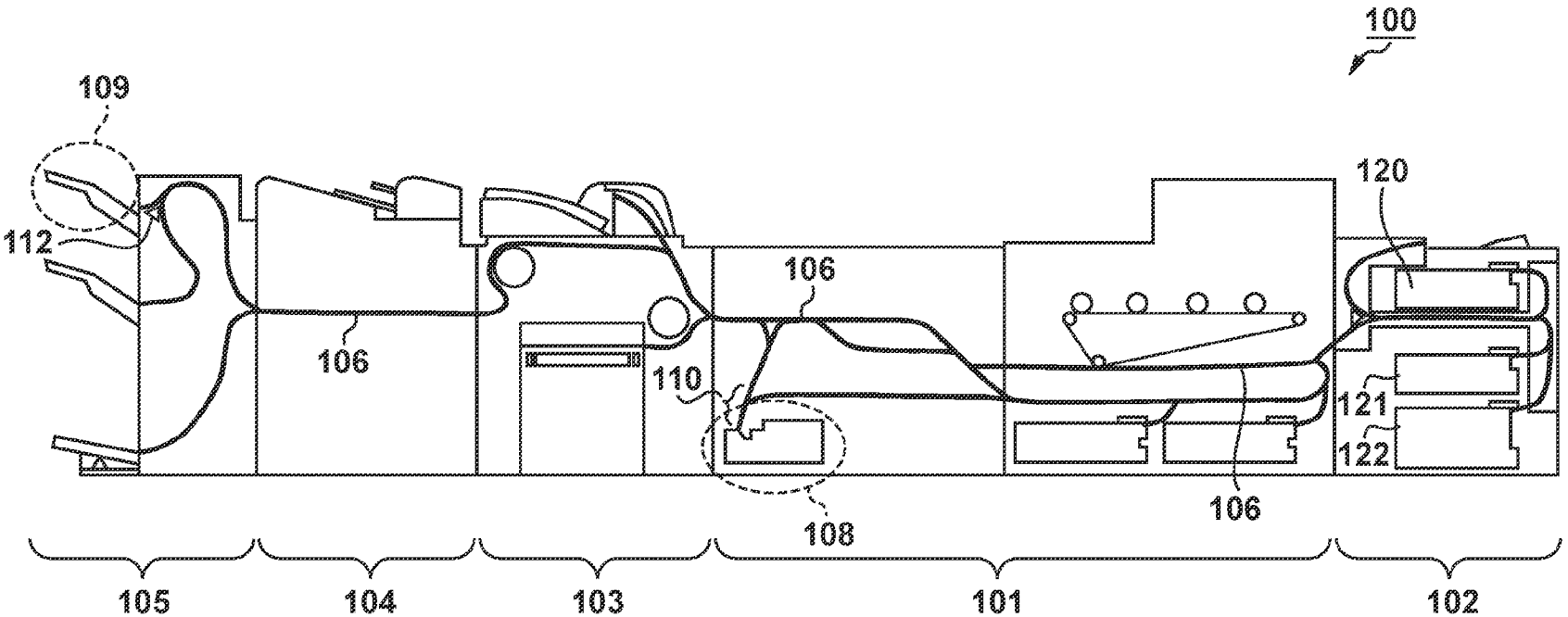
FIG. 1 is a sectional view showing the overall arrangement of a printing apparatus 100 according to an embodiment of the present invention.

FIG. 1 is a sectional view showing the overall arrangement of a printing apparatus according to an embodiment of the present invention. In this embodiment, as an application of the present invention, the printing apparatus 100 including a printing apparatus main body 101 and accessories 102 to 105 will be explained. The accessories 102 to 105 are optional apparatuses connected to the printing apparatus main body 101. Required optional apparatuses vary depending on the arrangement of the printing apparatus main body 101. One example of the printing apparatus main body 101 does not require any optional apparatus, and another example requires at least one of optional feeding and discharge apparatuses. In this embodiment, the printing apparatus 100 having an arrangement in which the feeding accessory 102 as an optional feeding apparatus and the discharge accessories 103 to 105 as optional discharge apparatuses are connected to the printing apparatus main body 101 will be exemplified.

The feeding accessory 102 includes a plurality of feeding units 120 to 122 each of which serves as a sheet feed source and stores sheets which will undergo print processing. In response to an instruction from the printing apparatus main body 101, the feeding accessory 102 separates a plurality of sheets stored in each of the feeding units 120 to 122, and sequentially feeds the separated sheets on a conveyance path 106 one by one. Furthermore, the feeding accessory 102 can continuously feed a plurality of sheets.

Each of the discharge accessories 103 to 105 serves as a discharge destination apparatus to which a sheet having undergone print processing in the printing apparatus main body 101 is finally discharged. Each of the discharge accessories 103 to 105 is, for example, a sheet processing apparatus which performs post-processing such as bookbinding and stapling for sheets having undergone print processing or a large-volume stacker for performing stacking processing for sheets having undergone print processing.

In the printing apparatus 100, a sheet is fed from the feeding accessory 102, and then conveyed toward the printing apparatus main body 101 through the conveyance path 106. The printing apparatus main body 101 performs print processing of printing an image on the sheet conveyed through the conveyance path 106 in accordance with an input job, thereby outputting a printed material. The printing apparatus main body 101 conveys, toward the discharge accessories 103 to 105, the sheet on which the image has been printed on a surface (one side or both sides).

The printing apparatus 100 includes a plurality of discharge units (for example, discharge units 108 and 109) at different positions in the middle of the conveyance path 106 of a fed sheet along the conveyance path from a sheet feed source to the discharge destination of the sheet having undergone print processing. The discharge units 108 and 109 can normally be used as the retraction destinations of sheets which remain on the conveyance path 106 when a sheet is jammed on the conveyance path 106 during execution of print processing. In the printing apparatus 100, the discharge units 108 and 109 are provided in the printing apparatus main body 101 and discharge accessory 105, respectively. Note that discharge units used as the retraction destinations of sheets as described above may also be provided in the discharge accessories 103 and 104, respectively.

The discharge unit 108 is provided in the middle of the conveyance path 106 within the printing apparatus main body 101. On the conveyance path 106, rollers 110 are used to convey a sheet to a reverse path for double-sided printing or to the discharge unit 108. To perform double-sided printing for a sheet, the printing apparatus main body 101 rotates the rollers 110 in the reverse direction while the sheet is held between the rollers 110, and feeds the sheet to the reverse path. This causes the printing apparatus main body 101 to reverse the printing surface of the sheet. Furthermore, the printing apparatus main body 101 can rotate the rollers 110 to feed and discharge the sheet on the conveyance path 106 to the discharge unit 108.

The discharge unit 109 is provided in the middle of the conveyance path 106 within the discharge accessory 105, and is arranged at a position visually perceivable from the outside of the printing apparatus 100. A printed material having undergone test print processing for prompting the user to check the printing status is normally discharged to the discharge unit 109. The discharge unit 109 is used as the discharge destination of a printed material which is output from the printing apparatus main body 101 by executing an adjustment job (to be described later). That is, the discharge unit 109 is normally used to discharge a printed material which is not used as a final result. Note that in this embodiment, the discharge unit 109 is an example of the second discharge unit.

The discharge accessory 105 can discharge a sheet on the conveyance path 106 to the sheet discharge unit 109 by operating (opening) a flapper 112 for guiding a sheet conveyed through the conveyance path 106 to the sheet discharge unit 109. In this embodiment, upon detecting the occurrence of a jam and accepting a sheet retraction instruction from the printing apparatus main body 101, the discharge accessory 105 operates the flapper 112, thereby discharging a sheet on the conveyance path 106 to the sheet discharge unit 109.

The printing apparatus 100 includes a plurality of sensors at different positions along the conveyance path 106. The plurality of sensors are provided in the printing apparatus main body 101, feeding accessory 102, and discharge accessories 103 to 105, respectively. The plurality of sensors are used to identify the positions of sheets on the conveyance path 106. In the printing apparatus 100, a number of rollers for conveying sheets through the conveyance path 106 are provided along the conveyance path 106, in addition to the rollers 110 provided in the printing apparatus main body 101.

Figure 2:
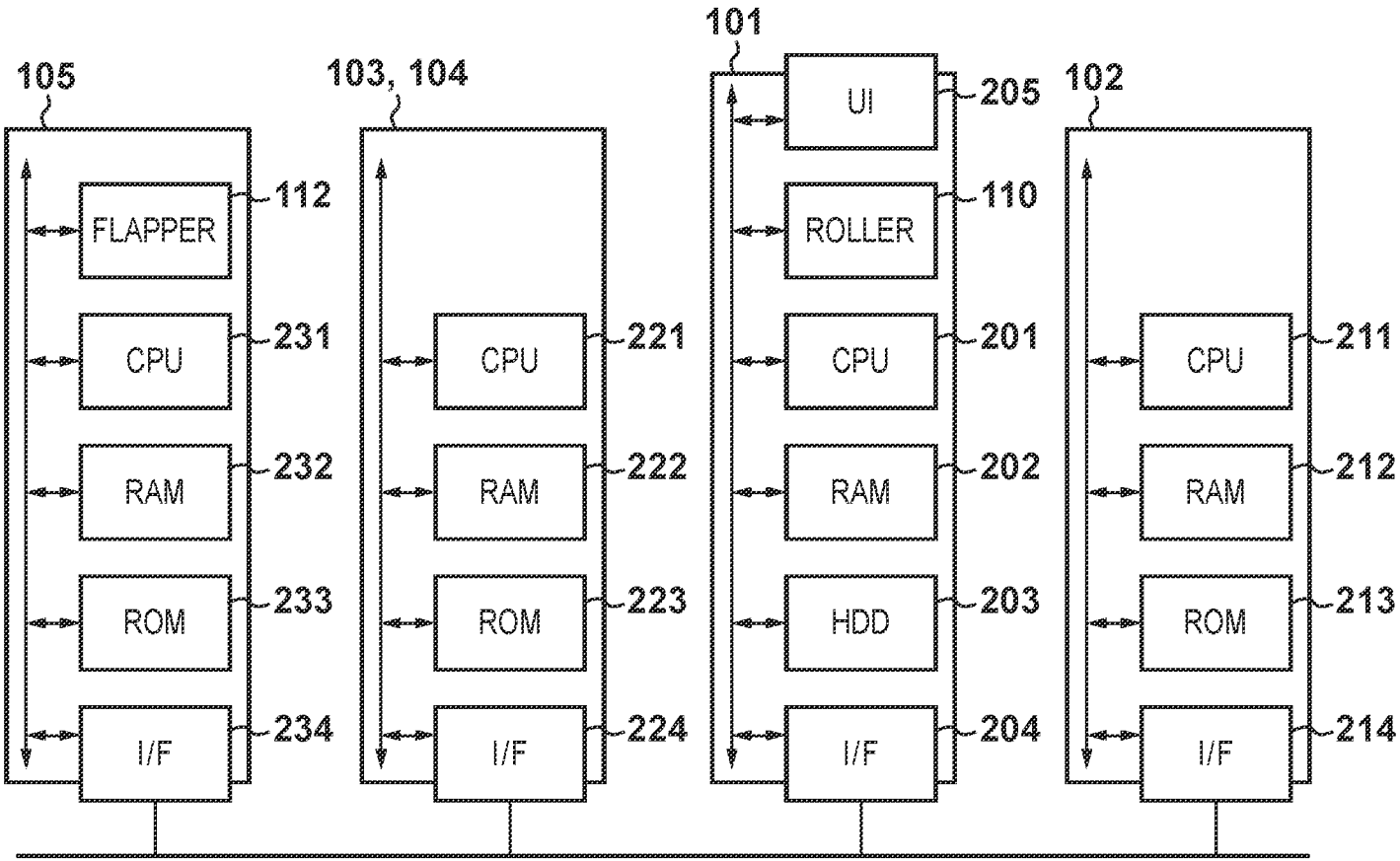
FIG. 2 is a block diagram showing the schematic hardware arrangement of the printing apparatus 100 according to the embodiment of the present invention.

In response to, for example, a user instruction given via an operation unit (a user interface (UI) 205 shown in FIG. 2) provided in the printing apparatus main body 101, the printing apparatus 100 performs acceptance processing of accepting input of a job to be executed by the printing apparatus 100. Furthermore, in response to a received instruction which has been transmitted by an external apparatus such as a PC, the printing apparatus 100 performs acceptance processing of accepting input of a job to be executed by the printing apparatus 100. The printing apparatus 100 can execute not only a general print job but also an "adjustment job" for adjusting the tint of a printed material (the tint of an image formed on a printed material) output from the printing apparatus main body 101. The adjustment job is a job for adjusting the tint of a printed material by causing the printing apparatus main body 101 to continuously output a plurality of printed materials. Moreover, it can be designated for the adjustment job that the last output final printed material of the plurality of printed materials output from the printing apparatus main body 101 should be usable in the next step (for example, post-processing). The adjustment job including such designation will be referred to as a "specific job" hereinafter.

FIG. 2 is a block diagram showing the schematic hardware arrangement of the printing apparatus 100. FIG. 2 particularly shows some of the devices of the printing apparatus 100, which are involved in execution of the above-described adjustment job. The discharge accessories 103 and 104 without a function of retracting a sheet have different functions while they have features in common in which there is neither a discharge unit for sheet retraction on the conveyance path 106 nor a flapper (like the flapper 112) for sheet retraction. Therefore, FIG. 2 shows the common arrangement of the discharge accessories 103 and 104. Note that as will be described later, in the discharge accessory 103, a discharge tray (discharge unit) usable as the discharge destination (retraction destination) of a sheet may be provided at a position visually perceivable from the outside of the apparatus.

The printing apparatus main body 101 includes a CPU 201 for controlling not only the printing apparatus main body 101 but also the overall operation of the printing apparatus 100 including the feeding accessory 102 and discharge accessories 103 to 105. The printing apparatus main body 101 also includes a RAM 202, a hard disk drive (HDD) 203, an interface (I/F) 204, and a user interface (UI) 205. The RAM 202 temporarily stores software (programs) executed by the CPU 201 and data used by the CPU 201. The HDD 203 stores software and data for the operation of the printing apparatus main body 101. The I/F 204 serves as a communication interface for communication with the feeding accessory 102 and discharge accessories 103 to 105. The UI 205 functions as an input interface used by the user to input an instruction and a display interface for displaying various kinds of information such as the operation information of the printing apparatus main body 101 and notification information for the user.

The feeding accessory 102 includes a CPU 211, a RAM 212, a ROM 213, and an I/F 214, the functions of which are the same as those of the above-described CPU 201, RAM 202, HDD 203, and I/F 204, respectively. The discharge accessory 103 or 104 includes a CPU 221, a RAM 222, a ROM 223, and an I/F 224, the functions of which are the same as those of the above-described CPU 201, RAM 202, HDD 203, and I/F 204, respectively. Moreover, the discharge accessory 105 includes a CPU 231, a RAM 232, a ROM 233, and an I/F 234, the functions of which are the same as those of the above-described CPU 201, RAM 202, HDD 203, and I/F 204, respectively.

Figure 3:
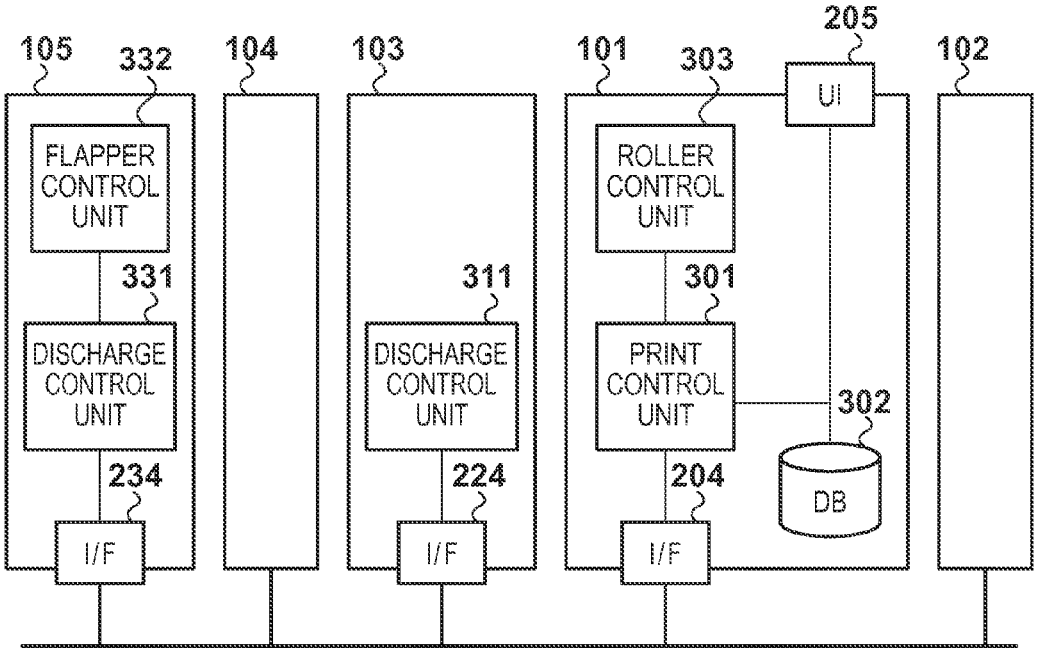
FIG. 3 is a block diagram showing the schematic software arrangement of the printing apparatus 100 according to the embodiment of the present invention.

FIG. 3 is a block diagram showing the software arrangement of the printing apparatus 100. FIG. 3 particularly shows some of the software modules of the printing apparatus 100, which are involved in execution of the above-described adjustment job. The function of each block shown in FIG. 3 is implemented by the CPUs 201, 211, 221, and 231 in the printing apparatus main body 101, feeding accessory 102, and discharge accessories 103 to 105, respectively. More specifically, the CPUs 201, 211, 221, and 231 read out control programs stored in the HDD 203 and ROMs 213, 223, and 233 onto the RAMs 202, 212, 222, and 223, and execute them, respectively. This processing implements the function of each block shown in FIG. 3.

A print control unit 301 of the printing apparatus main body 101 controls the overall operation of the printing apparatus 100, and also controls execution of printing in the printing apparatus 100 (printing apparatus main body 101). In execution of the adjustment job, the print control unit 301 decides the discharge destination of a printed material to be output from the printing apparatus main body 101, and executes discharge control for discharging the printed material to the decided discharge destination. A database (DB) 302 is a database stored in the HDD 203, and holds information shown in FIG. 4, as will be described later. A roller control unit 303 controls the operations of the rollers 110 provided in the printing apparatus main body 101.

If the discharge accessory 103 includes the above-described discharge tray (not shown), a discharge control unit 311 of the discharge accessory 103 controls discharge processing for discharging, to the discharge tray, a printed material output from the printing apparatus main body 101, in response to an instruction from the print control unit 301.

In response to an instruction from the print control unit 301, a discharge control unit 331 of the discharge accessory 105 controls discharge processing for discharging, to the discharge unit 109, a printed material output from the printing apparatus main body 101. In response to an instruction from the discharge control unit 331, a flapper control unit 332 controls the flapper 112 when discharging, to the discharge unit 109, a printed material output from the printing apparatus main body 101.

<Contents of Database 302>

FIG. 4 schematically shows an example of the information held in the database 302. The database 302 holds, for each hardware component (accessory) included in the printing apparatus 100, information indicating the connection state with the printing apparatus 100 (printing apparatus main body 101) and information about a discharge unit. The print control unit 301 updates the information held in the database 302 every time connection or release of connection of an accessory to the printing apparatus 100 (printing apparatus main body 101) is performed. When a new accessory is added to the printing apparatus 100, the print control unit 301 adds information about the added accessory to the database 302. On the other hand, if connection of one of the accessories is released, the print control unit 301 changes the information indicating the connection state of the accessory from "connection" to "non-connection".

<Print Processing of Printing Apparatus 100>

Figure 5:
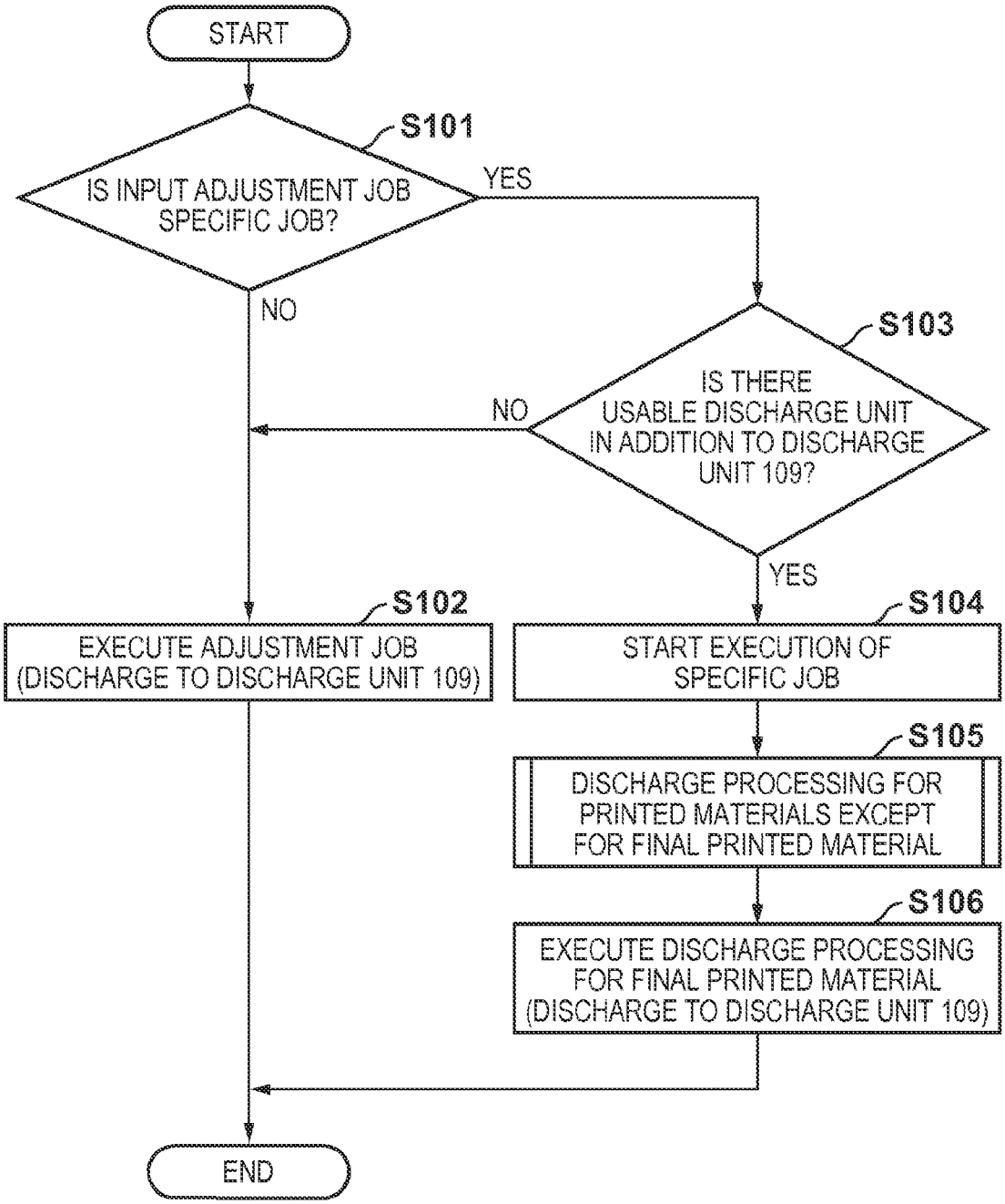
FIG. 5 is a flowchart illustrating a print processing procedure executed by the printing apparatus 100 (a printing apparatus main body 101) according to the embodiment of the present invention.

Print processing executed by the printing apparatus 100 (printing apparatus main body 101) according to the embodiment of the present invention will be described with reference to a flowchart shown in FIG. 5. In this embodiment, processing in each step of FIG. 5 is implemented in the printing apparatus 100 (printing apparatus main body 101) when the CPU 201 of the printing apparatus main body 101 reads out a control program stored in the HDD 203 onto the RAM 202, and executes it.

The print control unit 301 (CPU 201) performs acceptance processing of accepting input of a job based on an instruction input by the user via the UI 205 or an instruction received from an external apparatus via a network (not shown). In this example, the print control unit 301 accepts input of the adjustment job for adjusting the tint of a printed material by causing the printing apparatus main body 101 to continuously output a plurality of printed materials. Upon accepting input of the job, the print control unit 301 starts execution of the processing according to the flowchart shown in FIG. 5.

In step S101, the print control unit 301 determines whether the input adjustment job is the above-described specific job. That is, the print control unit 301 determines whether it is designated in the adjustment job to enable the last output final printed material of the plurality of printed materials output from the printing apparatus main body 101 to be usable for post-processing. If the print control unit 301 determines in step S101 that the input adjustment job is not the specific job, it advances the process to step S102; otherwise, it accepts the input adjustment job as the specific job, and the process advances to step S103.

In step S102, as the adjustment job, the print control unit 301 causes the feeding accessory 102 to continuously feed sheets, the number of which corresponds to the number of copies designated in the job, and causes the printing apparatus main body 101 to continuously execute printing of an image on each sheet. Image data used for printing on a sheet in the adjustment job may be included in the input adjustment job, or held in the printing apparatus main body 101 in advance. The print control unit 301 controls the printing apparatus main body 101 and discharge control unit 331 to discharge, to the discharge unit 109 (second discharge unit), all sheets (printed materials) for which printing is complete. In response to an instruction from the print control unit 301, the discharge control unit 331 causes the flapper control unit 332 to open the flapper 112, thereby guiding, to the discharge unit 109, a printed material output from the printing apparatus main body 101 and conveyed through the conveyance path. By executing the adjustment job in step S102, the tint of the printed material output from the printing apparatus main body 101 is adjusted and then stabilized.

On the other hand, in step S103, the print control unit 301 determines whether there is a discharge destination in addition to the discharge unit 109, which is usable as the discharge destination of the last output final printed material of the plurality of printed materials output by the adjustment job. At this time, the print control unit 301 performs the determination by referring to the database 302 and determining whether it is possible to identify one of apparatuses in a connection state, which has a usable discharge unit. In this way, the print control unit 301 determines whether the printing apparatus 100 includes a discharge unit (first discharge unit) different from the discharge unit 109 in addition to the discharge unit 109 (second discharge unit).

If the print control unit 301 determines in step S103 that there is a usable discharge unit in addition to the discharge unit 109, it advances the process to step S104 to start execution of the specific job. On the other hand, if the print control unit 301 determines that there is no such discharge unit, it advances the process to step S102. Note that in this embodiment, the printing apparatus main body 101 includes the discharge unit 108 as the discharge destination of a printed material, in addition to the discharge unit 109 included in the discharge accessory 105. The discharge unit 108 is identified based on the database 302. The print control unit 301, therefore, advances the process from step S103 to step S104.

When the print control unit 301 starts execution of the specific job in step S104, the printing apparatus main body 101 continuously outputs the printed materials on which an image has been printed, in order to adjust the tint of the printed material, similarly to the above-described adjustment job. Furthermore, in step S105, the print control unit 301 performs discharge control for discharging, to the discharge unit (discharge unit 108) identified in step S103, the printed materials except for the final printed material, which have been output from the printing apparatus main body 101 according to the specific job. In step S106, the print control unit 301 executes discharge control for discharging the final printed material to the discharge unit 109. Upon completion of discharge of the final printed material to the discharge unit 109, the print control unit 301 terminates execution of the specific job.

On the other hand, if the print control unit 301 advances the process from step S103 to step S102, the specific job is executed as the adjustment job in step S102, as described above. That is, in step S102, the print control unit 301 controls the discharge control unit 331 to discharge, to the discharge unit 109 (second discharge unit), the plurality of printed materials output from the printing apparatus main body 101, as usual. Upon completion of discharge of all the printed materials to the discharge unit 109, the print control unit 301 terminates execution of the specific job.

As described above, in this embodiment, upon accepting input of the specific job, the printing apparatus 100 determines whether there is a first discharge unit usable as the discharge destination of a printed material to be output, in addition to the second discharge unit (discharge unit 109) normally used by the adjustment job. If there is a first discharge unit (the discharge unit 108 in this example), among the plurality of printed materials output according to the specific job, the final printed material is discharged to the second discharge unit (discharge unit 109) and other printed materials are discharged to the first discharge unit (discharge unit 108). In this way, by respectively discharging the final printed material and other printed materials to different discharge units, the user can readily identify the final printed material.

After completion of discharge of the final printed material to the second discharge unit (discharge unit 109), the fact that the final printed material has been discharged to the second discharge unit may be displayed on the UI 205, thereby notifying the user of it. This allows the user to more reliably identify the final printed material.

If the printing apparatus 100 includes no first discharge unit (discharge unit 108), all the printed materials output according to the specific job are discharged to the second discharge unit (discharge unit 109), as described above. In this case, after completion of discharge of the plurality of printed materials to the discharge unit 109, the fact that the top one of the printed materials discharged and stacked on the discharge unit 109 is the final printed material may be displayed on the UI 205, thereby notifying the user of it. With this operation, even if it is impossible to respectively discharge the final printed material and other printed materials to different discharge units, it is possible to reduce the possibility that the user erroneously uses another printed material as the final printed material.

In the above-described embodiment, the second discharge unit (discharge unit 109) is arranged at a position visually perceivable from the outside of the printing apparatus 100, and the first discharge unit (discharge unit 108) is arranged inside the printing apparatus. In this case, upon completion of execution of the specific job, only the final printed material is visually perceivable from the outside of the printing apparatus 100, and thus the user can reliably identify the final printed material. Note that the positions of the first and first discharge units are not limited to them. That is, regardless of whether the first or first discharge unit is arranged at a position visually perceivable from the outside of the printing apparatus 100 or arranged inside the printing apparatus 100, it is possible to respectively discharge the final printed material and other printed materials to the different discharge units, thereby allowing the user to readily identify the final printed material.

The printing apparatus 100 may include, as first discharge units, a plurality of discharge units in addition to the discharge unit 108. In this case, the present invention can be implemented as various examples in accordance with the number and type (whether a discharge unit is arranged inside or outside the printing apparatus 100) of discharge units which are included as first discharge units in the printing apparatus 100. The first to third examples of the processing in step S105 will be described with reference to FIGS. 6 to 8, respectively. Note that in the following first to third examples, the discharge accessory 103 includes a discharge unit (discharge tray) at a position visually perceivable from the outside. That is, in addition to the discharge unit 108 inside the printing apparatus 100, the printing apparatus 100 includes, as a first discharge unit, a discharge unit arranged at a position (outside the printing apparatus 100) visually perceivable from the outside of the printing apparatus 100.

First Example

In the first example, if the printing apparatus 100 includes a plurality of discharge units (first discharge units) usable as the discharge destinations of other printed materials and such discharge unit is arranged inside the printing apparatus 100, the print control unit 301 preferentially uses the internal discharge unit. The final printed material is discharged to the discharge unit 109 outside the printing apparatus 100. This allows only the final printed material to be readily, visually perceivable from the outside of the printing apparatus 100 upon completion of execution of the specific job, and thus the user can more reliably identify the final printed material.

Figure 6:
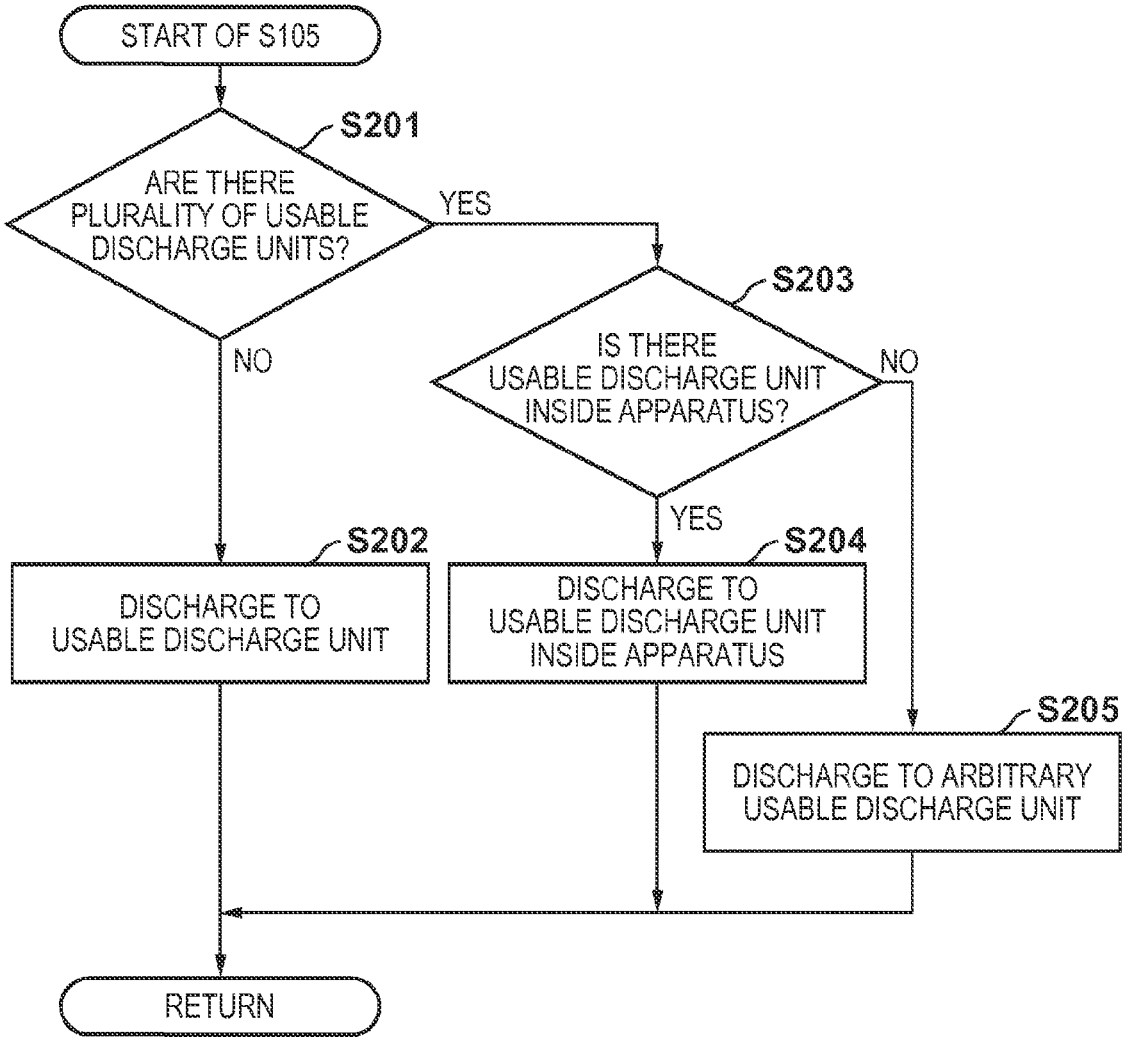
FIG. 6 is a flowchart illustrating the procedure of discharge processing (first example) for printed materials except for the final printed material, which is executed in the printing apparatus 100 according to the embodiment of the present invention.

FIG. 6 is a flowchart illustrating the procedure of discharge processing (first example) for the printed materials except for the final printed material, which is executed in the printing apparatus 100 according to the embodiment of the present invention. In step S201, the print control unit 301 refers to the database 302 to determine whether there are a plurality of discharge units usable as first discharge units. If the print control unit 301 determines that there is only one usable discharge unit ("NO" in step S201), it advances the process to step S202 to execute discharge control for discharging the printed materials except for the final printed material to the discharge unit. On the other hand, if the print control unit 301 determines that there are a plurality of usable discharge units ("YES" in step S201), it advances the process to step S203.

In step S203, the print control unit 301 determines whether there is a discharge unit inside the printing apparatus 100 among the discharge units identified in step S201. If the print control unit 301 determines that there is a discharge unit inside the printing apparatus 100, it advances the process to step S204 to execute discharge control for discharging the printed materials except for the final printed material to the discharge unit (the discharge unit 108 in this example) inside the printing apparatus 100. On the other hand, if the print control unit 301 determines that there is no discharge unit inside the printing apparatus 100 (it is assumed that there is no discharge unit 108), it advances the process to step S205. In step S205, the print control unit 301 executes discharge control for discharging the printed materials except for the final printed material to an arbitrary usable discharge unit (the discharge tray of the discharge accessory 103 in this example).

Second Example

In the second example, if the printing apparatus 100 includes a plurality of discharge units (first discharge units) usable as the discharge destinations of other printed materials and such discharge unit is arranged outside the printing apparatus 100, the print control unit 301 preferentially uses the external discharge unit. The final printed material is discharged to the discharge unit 109 outside the printing apparatus 100. This allows the user to readily identify the final printed material upon completion of execution of the specific job, and also allows the user to readily remove, from the printing apparatus 100, the printed materials which are output only for adjustment of the tint of the printed material.

Figure 7:
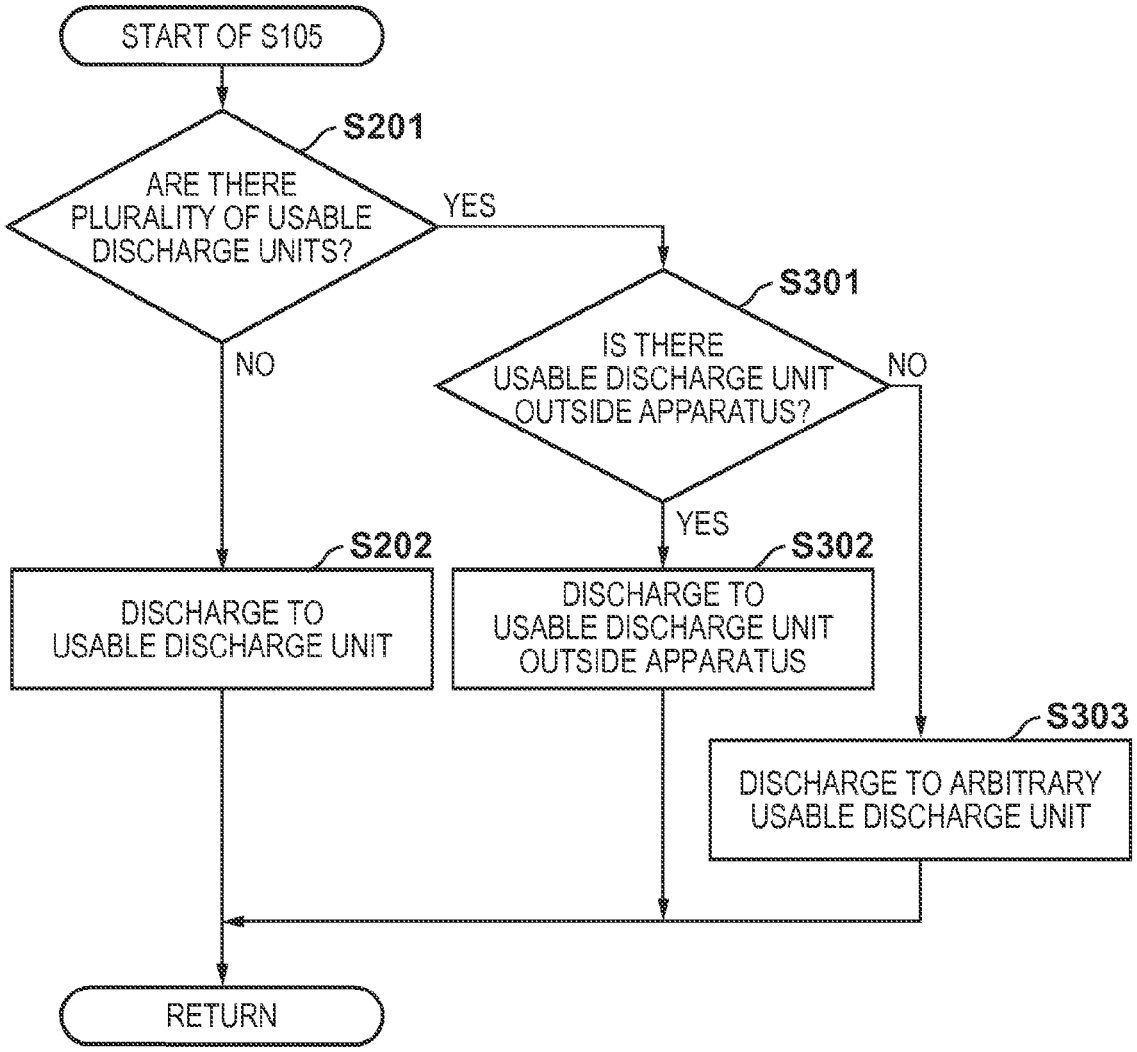
FIG. 7 is a flowchart illustrating the procedure of discharge processing (second example) for printed materials except for the final printed material, which is executed in the printing apparatus 100 according to the embodiment of the present invention.

FIG. 7 is a flowchart illustrating the procedure of discharge processing (second example) for the printed materials except for the final printed material, which is executed in the printing apparatus 100 according to the embodiment of the present invention. Note that processing in steps S201 and S202 is the same as that in the first example and a description thereof will be omitted.

If the process advances from step S201 to step S301, the print control unit 301 determines in step S301 whether there is a discharge unit outside the printing apparatus 100 among discharge units identified in step S201. If the print control unit 301 determines that there is a discharge unit outside the printing apparatus 100, it advances the process to step S302 to execute discharge control for discharging the printed materials except for the final printed material to the discharge unit (the discharge tray of the discharge accessory 103 in this example) outside the printing apparatus 100. On the other hand, if the print control unit 301 determines that there is no discharge unit outside the printing apparatus 100 (it is assumed that there is no discharge tray of the discharge accessory 103), it advances the process to step S303. In step S303, the print control unit 301 executes discharge control for discharging the printed materials except for the final printed material to an arbitrary usable discharge unit (the discharge unit 108 in this example).

Third Example

In the first and second examples, if the printing apparatus 100 includes a plurality of discharge units (first discharge units) usable as the discharge destinations of other printed materials, the print control unit 301 determines in advance which of the discharge units provided outside and inside the printing apparatus 100 is preferentially used. The print control unit 301, however, may prompt the user to designate which of the discharge units provided outside and inside the printing apparatus 100 should be preferentially used. This designation operation may be performed by the user via the UI 205. In this example, if a discharge unit arranged at a position visually perceivable from the outside of the printing apparatus 100 and a discharge unit arranged inside the printing apparatus 100 are included, the print control unit 301 preferentially discharges the printed materials except for the final printed material to the discharge unit designated by the user. The final printed material is discharged to the discharge unit 109 (second discharge unit) outside the printing apparatus 100. This makes it possible to decide the discharge destinations of the printed materials except for the final printed material according to the user's needs, thereby improving the user convenience.

Figure 8:
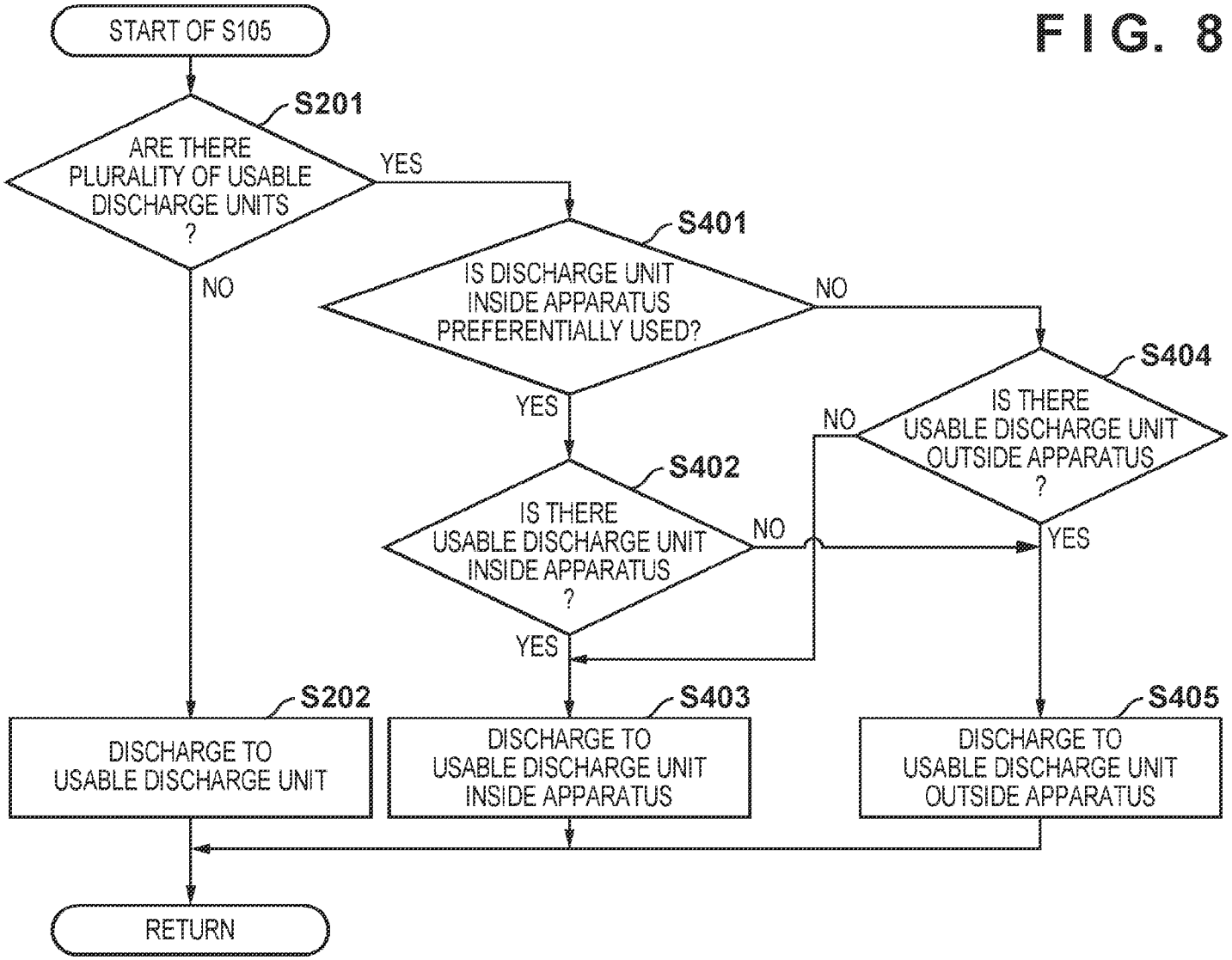
FIG. 8 is a flowchart illustrating the procedure of discharge processing (third example) for printed materials except for the final printed material, which is executed in the printing apparatus 100 according to the embodiment of the present invention.

FIG. 8 is a flowchart illustrating the procedure of discharge processing (third example) for the printed materials except for the final printed material, which is executed in the printing apparatus 100 according to the embodiment of the present invention. Note that processing in steps S201 and S202 is the same as that in the first and second examples and a description thereof will be omitted.

In step S401, in accordance with designation by the user via the UI 205, the print control unit 301 determines whether the discharge unit (the discharge unit 108 in this example) inside the printing apparatus 100 should be preferentially used. If the print control unit 301 determines that the discharge unit inside the printing apparatus 100 should be preferentially used, it advances the process to step S402; otherwise, it advances the process to step S404. In step S402 or S404, the print control unit 301 determines whether there is a usable discharge unit inside or outside the printing apparatus 100. If there is a usable discharge unit, it advances the process to step S403 or S405. In step S403 or S405, the print control unit 301 discharges the printed materials except for the final printed material to the discharge unit (the discharge unit 108 or the discharge tray of the discharge accessory 103) provided inside or outside the printing apparatus 100. In this way, the discharge unit designated by the user is preferentially used as the discharge destinations of the printed materials except for the final printed material.

On the other hand, if the print control unit 301 determines in step S402 or S404 that there is no usable discharge unit inside or outside the printing apparatus 100, it advances the process to step S405 or S403. If there is no discharge unit designated by the user, the printed materials except for the final printed material are discharged to a usable discharge unit existing in the printing apparatus 100.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-194406, filed Sep. 4, 2012, which is hereby incorporated by reference herein in its entirety.

What is claimed is:

1. A printing apparatus comprising:

an execution unit configured to execute an adjustment job for printing an image on a plurality of sheets for adjusting a tint of the printed image;

a control unit configured to control to continuously discharge, to a first discharge unit, sheets except for a last sheet among the plurality of sheets on which the image is printed by executing the adjustment job by the execution unit, and to discharge the last sheet to a second discharge unit different from the first discharge unit; and a determination unit configured to determine whether the printing apparatus includes the first discharge unit, wherein if the determination unit determines that the printing apparatus does not include the first discharge unit, the control unit discharges the plurality of sheets to the second discharge unit, and notifies a user that a top one of the sheets discharged to the second discharge unit is the last sheet.

2. The apparatus according to claim 1, wherein if the determination unit determines that the printing apparatus includes the first discharge unit, the control unit notifies the user that the last sheet has been discharged to the second discharge unit after the last sheet and the sheets except for the last sheet were discharged to the second discharge unit and the first discharge unit, respectively.

3. The apparatus according to claim 1, wherein the first discharge unit is arranged inside the printing apparatus, and the second discharge unit is arranged at a position visually perceivable from an outside of the printing apparatus.

4. A printing apparatus, comprising:

an execution unit configured to execute an adjustment job for printing an image on a plurality of sheets for adjusting a tint of the printed image; and a control unit configured to control to continuously discharge, to a first discharge unit, sheets except for a last sheet among the plurality of sheets on which the image is printed by executing the adjustment job by the execution unit, and to discharge the last sheet to a second discharge unit different from the first discharge unit, wherein the first discharge unit includes at least one of a discharge unit arranged at a position visually perceivable from an outside of the printing apparatus and a discharge unit arranged inside the printing apparatus, and the second discharge unit is arranged at a position visually perceivable from the outside of the printing apparatus, and wherein if the printing apparatus includes the first discharge unit, and the first discharge unit includes the discharge unit arranged inside the printing apparatus, the control unit preferentially discharges the sheets except for the last sheet to the discharge unit, arranged inside the printing apparatus, of the first discharge unit, and discharges the last sheet to the second discharge unit.

5. A printing apparatus, comprising:

an execution unit configured to execute an adjustment job for printing an image on a plurality of sheets for adjusting a tint of the printed image; and a control unit configured to control to continuously discharge, to a first discharge unit, sheets except for a last sheet among the plurality of sheets on which the image is printed by executing the adjustment job by the execution unit, and to discharge the last sheet to a second discharge unit different from the first discharge unit, wherein the first discharge unit includes at least one of a discharge unit arranged at a position visually perceivable from an outside of the printing apparatus and a discharge unit arranged inside the printing apparatus, and the second discharge unit is arranged at a position visually perceivable from the outside of the printing apparatus, and wherein if the printing apparatus includes the first discharge unit, and the first discharge unit includes the discharge unit arranged at the position visually perceivable from the outside of the printing apparatus, the control unit preferentially discharges the sheets except for the last sheet to the discharge unit, arranged at the position visually perceivable from the outside of the printing apparatus, of the first discharge unit, and discharges the last sheet to the second discharge unit.

6. A printing apparatus comprising:

an execution unit configured to execute an adjustment job for printing an image on a plurality of sheets for adjusting a tint of the printed image; and a control unit configured to control to continuously discharge, to a first discharge unit, sheets except for a last sheet among the plurality of sheets on which the image is printed by executing the adjustment job by the execution unit, and to discharge the last sheet to a second discharge unit different from the first discharge unit, wherein the first discharge unit includes at least one of a discharge unit arranged at a position visually perceivable from an outside of the printing apparatus and a discharge unit arranged inside the printing apparatus, and the second discharge unit is arranged at a position visually perceivable from the outside of the printing apparatus, and wherein the printing apparatus further comprising a designation unit configured to prompt the user to designate which of the discharge unit arranged at the position visually perceivable from the outside of the printing apparatus and the discharge unit arranged inside the printing apparatus should be preferentially used as a discharge destination of the last sheet, and wherein if the printing apparatus includes the first discharge unit, and the first discharge unit includes the discharge unit arranged at the position visually perceivable from the outside of the printing apparatus and the discharge unit arranged inside the printing apparatus, the control unit preferentially discharges the sheets except for the last sheet to the discharge unit, designated by the user through the designation unit, of the first discharge unit, and discharges the last sheet to the second discharge unit.

7. A method for controlling a printing apparatus, comprising steps of:

executing an adjustment job for printing an image on a plurality of sheets for adjusting a tint of the printed image;

controlling to continuously discharge, to a first discharge unit, sheets except for a last sheet among the plurality of sheets on which the image is printed by executing the adjustment job in the execution step, and to discharge the last sheet to a second discharge unit different from the first discharge unit; and determining whether the printing apparatus includes the first discharge unit, wherein if it is determined in the determining step that the printing apparatus does not include the first discharge unit, the plurality of sheets is discharged to the second discharge unit, and a user is notified that a top one of the sheets discharged to the second discharge unit is the last sheet.

8. A computer-readable storage medium storing a computer program for causing a computer to execute steps of a method for controlling a printing apparatus, the method comprising steps of:

executing an adjustment job for printing an image on a plurality of sheets for adjusting a tint of the printed image;

controlling to continuously discharge, to a first discharge unit, sheets except for a last sheet among the plurality of sheets on which the image is printed by executing the adjustment job in the execution step, and to discharge the last sheet to a second discharge unit different from the first discharge unit; and determining whether the printing apparatus includes the first discharge unit, wherein if it is determined in the determining step that the printing apparatus does not include the first discharge unit, the plurality of sheets is discharged to the second discharge unit, and a user is notified that a top one of the sheets discharged to the second discharge unit is the last sheet.

* * * * *